US012064004B2

(12) United States Patent
Sakaguchi et al.

(10) Patent No.: US 12,064,004 B2
(45) Date of Patent: Aug. 20, 2024

(54) PLATE, SHOE SOLE, AND SHOE

(71) Applicant: ASICS CORPORATION, Kobe (JP)

(72) Inventors: Masanori Sakaguchi, Kobe (JP); Kenji Hirata, Kobe (JP); Genki Hatano, Kobe (JP); Hiroaki Nishimura, Kobe (JP); Shingo Takashima, Kobe (JP); Yuya Kozuka, Kobe (JP); Fumitomo Hishikawa, Kobe (JP); Takayuki Kogure, Kobe (JP)

(73) Assignee: ASICS CORPORATION, Kobe (JP)

( * ) Notice: Subject to any disclaimer, the term of this patent is extended or adjusted under 35 U.S.C. 154(b) by 53 days.

(21) Appl. No.: 17/489,548

(22) Filed: Sep. 29, 2021

(65) Prior Publication Data

US 2022/0104581 A1 Apr. 7, 2022

(30) Foreign Application Priority Data

Oct. 2, 2020 (JP) ..... 2020-167553

(51) Int. Cl.
*A43B 13/14* (2006.01)

(52) U.S. Cl.
CPC ..... *A43B 13/141* (2013.01)

(58) Field of Classification Search
CPC .... A43B 13/141; A43B 13/125; A43B 13/127
USPC ..... 33/117.3
See application file for complete search history.

(56) References Cited

U.S. PATENT DOCUMENTS

| | | | | |
|---|---|---|---|---|
| 9,320,318 | B2 | 4/2016 | Nurse et al. | |
| 10,470,521 | B2 | 11/2019 | Iuchi et al. | |
| 10,842,224 | B2 | 11/2020 | Farina et al. | |
| 2017/0095034 | A1* | 4/2017 | Dupre | A43B 13/20 |
| 2018/0132564 | A1 | 5/2018 | Bruce et al. | |
| 2021/0227930 | A1* | 7/2021 | Dupre | A43B 7/18 |

FOREIGN PATENT DOCUMENTS

| | | | |
|---|---|---|---|
| DE | 102016118168 | A1 | 11/2017 |
| EP | 3797631 | A1 | 3/2021 |
| JP | 2018529461 | A | 10/2018 |

(Continued)

OTHER PUBLICATIONS

Communication pursuant to Article 94(3) EPC dated Nov. 28, 2022, 5 pp. for Application No. 21197086.8-1015.

(Continued)

*Primary Examiner* — Alissa L Hoey
*Assistant Examiner* — Akwokwo Olabisi Redhead
(74) *Attorney, Agent, or Firm* — KONRAD, RAYNES, DAVDA & VICTOR LLP; Alan S. Raynes

(57) ABSTRACT

A plate includes: a curved portion located in a forefoot region and shaped to curve toward a flat plane; a midfoot supporting portion located in a midfoot region; and a rear-foot supporting portion located in a rear foot region. The curved portion has a wide region including a wide portion of which dimension in a width direction is largest in the curved portion. The midfoot supporting portion has a narrow region including a narrow portion of which dimension in the width direction is smallest in the midfoot supporting portion. A ratio of a bending rigidity of the narrow region to a bending rigidity of the wide region is 0.4 or more and 0.85 or less.

20 Claims, 24 Drawing Sheets

(56) References Cited

FOREIGN PATENT DOCUMENTS

| | | |
|---|---|---|
| WO | 2017058420 A1 | 4/2017 |
| WO | 2020136916 A1 | 7/2020 |

OTHER PUBLICATIONS

European search report dated Mar. 7, 2022, pp. 7, for Application No. 21197086.8-1005.
Japanese Office Action dated Mar. 21, 2024, for Application No. 2020-167553 and English translation (8 pages total).

* cited by examiner

PLATE, SHOE SOLE, AND SHOE

This non-provisional application is based on Japanese Patent Application No. 2020-167553 filed on Oct. 2, 2020 with the Japan Patent Office, the entire contents of which are hereby incorporated by reference.

BACKGROUND OF THE INVENTION

Field of the Invention

The present disclosure relates to a plate, a shoe sole, and a shoe.

Description of the Background Art

Shoes worn for sports are intended to satisfy requirements such as reduction of foot fatigue that is induced during running or exercise. For example, WO2020/136916 discloses a shoe that can reduce energy generated by the ankle joint. This shoe has a shoe sole including: a rear bottom surface part that is to be in contact, when placed on a flat virtual surface, with the virtual surface; a toe portion of which height from the virtual surface is 170% or more and 250% or less with respect to a thickness dimension in the rear bottom surface part; and a front bottom surface part that continues to a front part of the rear bottom surface part and also curvedly extends to the toe portion to be spaced away from the virtual surface.

SUMMARY OF THE INVENTION

The shoe as disclosed in WO2020/136916 is desired to further reduce the energy generated at the ankle joint by restraining motion of the ankle joint during the phase from initial contact with the ground to take-off.

An object of the present disclosure is to provide a plate, a shoe sole, and a shoe that enable reduction of an angular change of the ankle joint during the phase from initial contact with the ground to take-off.

A plate according to an aspect of the present disclosure is a plate used for a shoe sole forming a part of a shoe, the plate includes: a curved portion located in a forefoot region of the shoe sole, the forefoot region overlapping, in a thickness direction of the shoe sole, a forefoot portion of a wearer of the shoe, the curved portion being shaped to curve toward a flat plane, in the shoe sole placed on the flat plane; a midfoot supporting portion located in a midfoot region of the shoe sole, the midfoot region overlapping, in the thickness direction, a midfoot portion of the wearer, the midfoot supporting portion supporting the midfoot portion; and a rear-foot supporting portion located in a rear foot region of the shoe sole, the rear foot region overlapping, in the thickness direction, a rear foot portion of the wearer, the rear-foot supporting portion supporting at least a part of the rear foot portion. The curved portion has a wide region including a wide portion of which dimension in a width direction is largest in the curved portion. The midfoot supporting portion has a narrow region including a narrow portion of which dimension in the width direction is smallest in the midfoot supporting portion. A ratio of a bending rigidity of the narrow region to a bending rigidity of the wide region is 0.4 or more and 0.85 or less.

A shoe sole according to an aspect of the present disclosure includes: the plate as described above; a midsole including the forefoot region, the midfoot region, and the rear foot region. The plate is placed within the midsole in such a manner that the curved portion is located in the forefoot region and the midfoot supporting portion is located in the midfoot region. The midsole includes: a lower midsole placed under the plate; and an upper midsole placed over the plate. The lower midsole includes a supporting portion that supports an entire area of the curved portion. The supporting portion is elastically deformable to allow the curved portion to deform in such a manner that reduces a curvature of the wide region. A thickness of a part of the supporting portion that overlaps the plate in the thickness direction and overlaps, in the thickness direction, at least a part extending frontward from the wide portion is constant.

A shoe according to an aspect of the present disclosure includes: a shoe sole as described above; and an upper connected to the shoe sole and located over the shoe sole.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
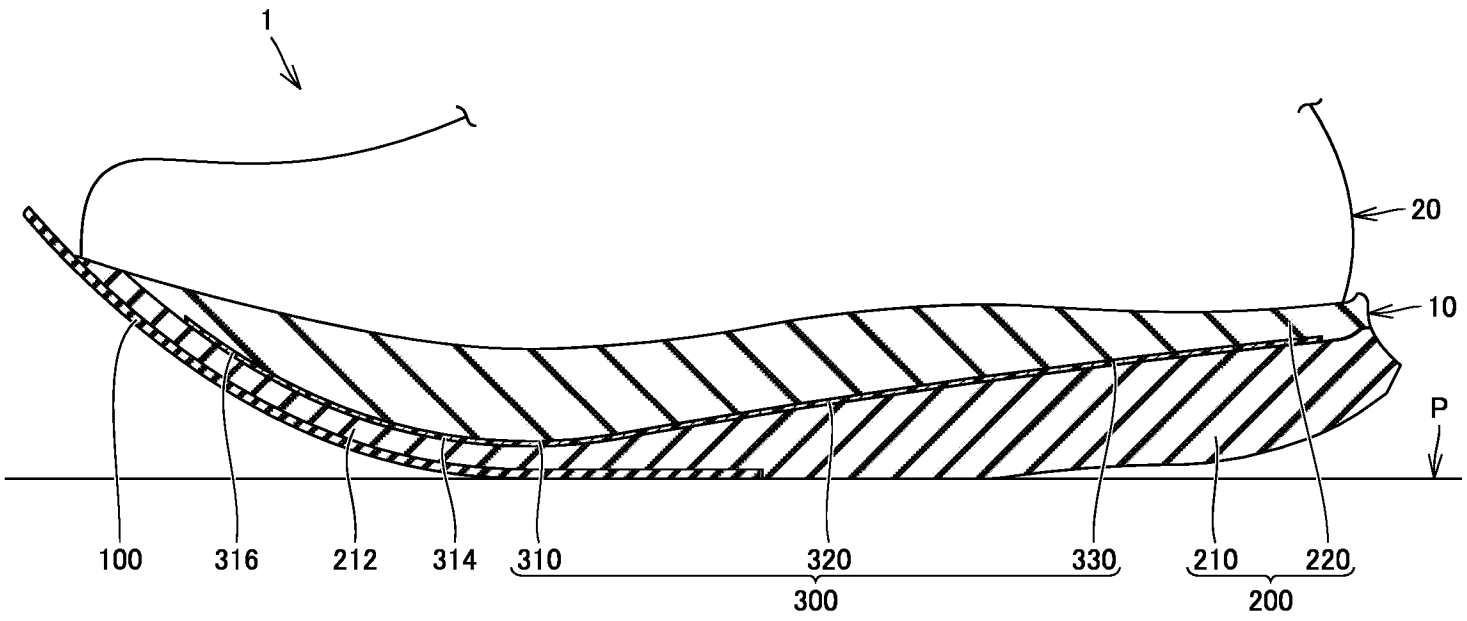
FIG. 1 is a cross-sectional view schematically showing a shoe according to an embodiment of the present invention.

Embodiments of the present disclosure are described with reference to the drawings. In the drawings referenced below, the same or corresponding parts are denoted by the same reference numerals. In the following description, terms such as longitudinal direction, width direction, frontward, and rearward are used. These terms representing direction each indicate a direction as seen from a viewpoint of a wearer of a shoe 1 placed on a flat plane P (see FIG. 1) such as ground. For example, frontward is toward the toe and rearward is toward the heel. Moreover, inner/inner side/inward is the inner side (first-toe side) of the foot in the width direction (lateral direction in FIG. 2), and outer/outer side/outward is the outer side of the foot in the width direction.

Figure 2:
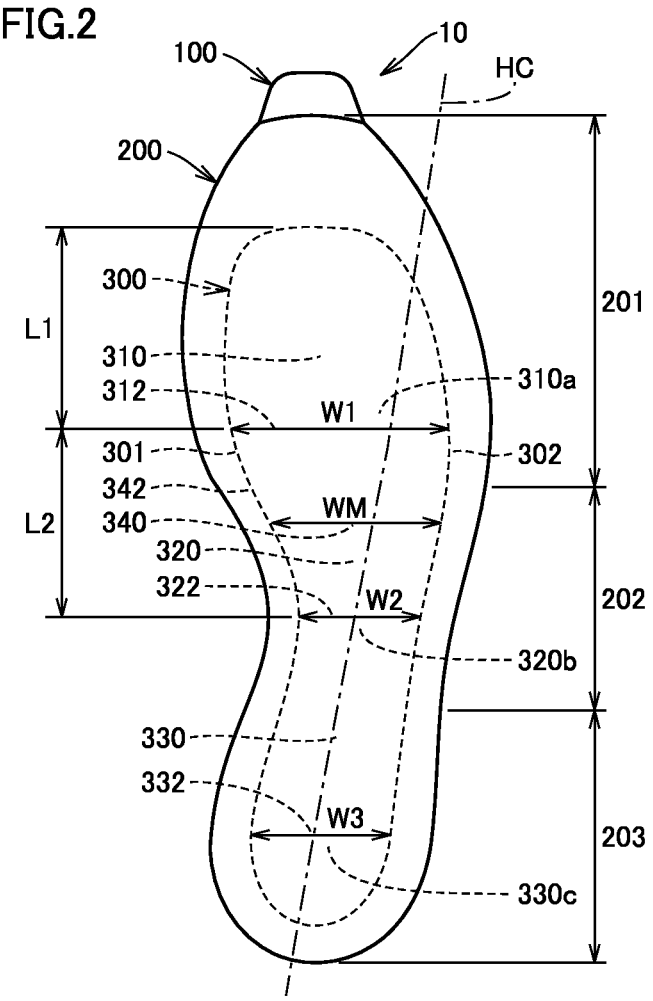
FIG. 2 is a plan view of a shoe sole.

FIG. 1 is a cross-sectional view schematically showing a shoe according to an embodiment of the present invention. FIG. 2 is a plan view of a shoe sole. While FIG. 2 shows a shoe sole 10 for the right foot, the shoe sole 10 is also applicable to the left foot and the shoe sole for the left foot is symmetrical to the shoe sole 10 for the right foot. While the shoe 1 according to the present embodiment is suitable for running, for example, the shoe 1 may also be used as other sports shoes and walking shoes, and the use of the shoe is not limited to a particular one.

As shown in FIG. 1, the shoe 1 includes the shoe sole 10 and an upper 20.

The upper 20 is connected to the shoe sole 10 and located over the shoe sole 10. The upper 20 and the shoe sole 10 together form a space for receiving a foot.

As shown in FIGS. 1 and 2, the shoe sole 10 includes an outsole 100, a midsole 200, and a plate 300.

The outsole 100 forms a part that is to make contact with the ground. The outsole 100 is made of rubber or the like. The outsole 100 extends mainly over a region from a forefoot region 201 to a midfoot region 202 which are described later herein. The region over which the outsole 100 extends is not limited to the above-described one, and the outsole 100 may extend further to a rear foot region 203 which is described later herein, or may also be configured to extend over the forefoot region 201 and the rear foot region 203 and not to extend over the midfoot region 202.

The midsole 200 is placed over the outsole 100. The upper 20 is placed over the midsole 200. Namely, the midsole 200 is located between the upper 20 and the outsole 100. The midsole 200 is formed of a foamed material of resin or the like. The midsole 200 includes the forefoot region 201, the midfoot region 202, and the rear foot region 203.

The forefoot region 201 is a region overlapping, in the thickness direction of the shoe sole 10, a forefoot portion of a wearer of the shoe 1. The forefoot portion is a part of the foot of the wearer located frontward in the longitudinal direction (top-to-bottom direction in FIG. 2) of the shoe 1. The forefoot region 201 is a region extending from approximately 0% to 30% with respect to the total length of the shoe 1 from the front end to the rear end of the shoe 1.

The midfoot region 202 is a region overlapping, in the thickness direction of the shoe sole 10, a midfoot portion of a wearer of the shoe 1. The midfoot portion is a part of the foot of the wearer located centrally in the longitudinal direction. The midfoot region 202 is a region extending from approximately 30% to 80% with respect to the total length of the shoe 1 from the front end to the rear end of the shoe 1.

The rear foot region 203 is a region overlapping, in the thickness direction of the shoe sole 10, a rear foot portion of a wearer of the shoe 1. The rear foot portion is a part of the foot of the wearer located rearward in the longitudinal direction. The rear foot region 203 is a region extending from approximately 80% to 100% with respect to the total length of the shoe 1 from the front end to the rear end of the shoe 1.

The plate 300 is placed within the midsole 200. The plate 300 is higher in rigidity than the midsole 200. The plate 300 is made of fiber-reinforced resin or non-fiber-reinforced resin. Fibers used for the fiber-reinforced resin may be carbon fibers, glass fibers, aramid fibers, DYNEEMA® fibers, ZYLON® fibers, boron fibers, or the like. The non-fiber-reinforced resin may be a polymer resin such as polyurethane-based thermoplastic elastomer (TPU) or amide-based thermoplastic elastomer (TPA).

The plate 300 includes a curved portion 310, a midfoot supporting portion 320, and a rear-foot supporting portion 330.

The curved portion 310 is located in the forefoot region 201. The curved portion 310 is shaped to curve toward a flat plane P (see FIG. 1), in the shoe sole 10 placed on the flat plane P. The curved portion 310 supports the forefoot portion.

The curvature of the curved portion 310 is not constant. Specifically, the curved portion 310 includes a gradual-curvature-increase portion 314 (see FIG. 1) in which the curvature changes to increase gradually from the rear toward the front in the longitudinal direction. The gradual-curvature-increase portion 314 contributes to a gradual change of a resilience force of the curved portion 310. The curvature of a part 316 located frontward of the gradual-curvature-increase portion 314 of the curved portion 310 is set smaller than the curvature of the gradual-curvature-increase portion 314. The curvature of the curved portion 310 is not limited to the above-described one, and the curvature of the curved portion 310 may be set to a middle curvature, a large curvature, and a small curvature, from the rear toward the front in the longitudinal direction.

Figure 3:
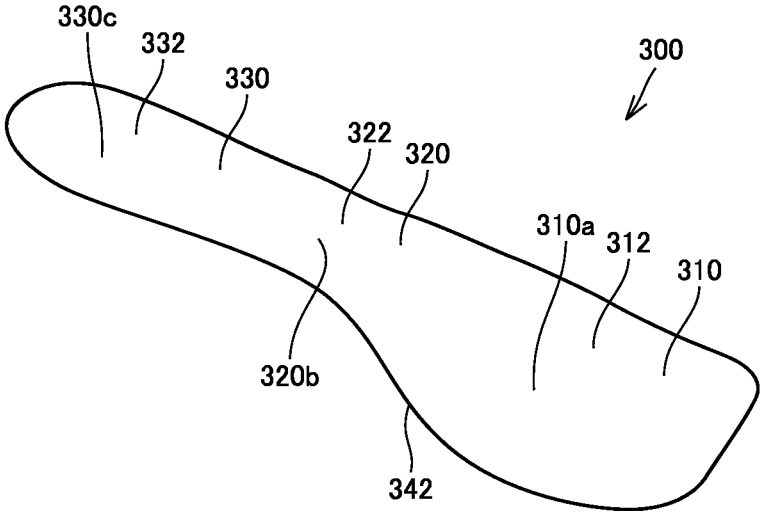
FIG. 3 is a perspective view of a plate.

As shown in FIGS. 2 and 3, the curved portion 310 has a wide region 310*a*. The wide region 310*a* is a region including a wide portion 312. The wide portion 312 is a portion of which dimension in the width direction is largest in the curved portion 310. The wide portion 312 is located to overlap the MP joints of the foot. The wide region 310*a* is defined in a range of 25% or more and 75% or less with respect to the total length of the plate 300, from the front end toward the rear end of the plate 300. For example, for the shoe 1 of 26 cm in size, preferably the plate 300 has a total length of 240 mm and a length L1 from the front end to the wide portion 312 of the plate 300 is defined in a range of 60 mm or more and 100 mm or less.

The midfoot supporting portion 320 is located in the midfoot region 202. The midfoot supporting portion 320 supports the midfoot portion. The midfoot supporting portion 320 is shaped to extend rearward from the rear end of the curved portion 310.

As shown in FIGS. 2 and 3, the midfoot supporting portion 320 has a narrow region 320*b*. The narrow region 320*b* is a region including a narrow portion 322. The narrow portion 322 is a portion of which dimension in the width direction is smallest in the midfoot supporting portion 320. In the present embodiment, the narrow portion 322 is formed by the part having the smallest dimension in the width direction, in the entire plate 300. The narrow region 320*b* is defined in a range of 50% to 80% with respect to the total length of the plate 300, from the front end toward the rear end of the plate 300. The length of the narrow region 320*b* in the longitudinal direction is set to 10% or more of the total length of the plate 300. For example, for a shoe 1 of 26 cm in size, preferably the plate 300 has a total length of 240 mm and a length L2 from the wide portion 312 to the narrow portion 322 is defined in a range of 60 mm or more and 84 mm or less.

The narrow region 320*b* is formed flat "Flat" herein refers to a state of the narrow region 320*b* where, for a shoe 1 of 26 cm in size for example, the top surface and the bottom surface of the narrow region 320*b* are located within a range of ±2 mm in the direction orthogonal to a flat plane on which the narrow region 320*b* is placed, from a reference plane extending in parallel to the flat plane and extending through the narrow region 320*b*.

The ratio of the bending rigidity of the narrow region 320*b* to the bending rigidity of the wide region 310*a* is 0.4 or more and 0.85 or less. More specifically, the ratio of the bending rigidity of the narrow portion 322 to the bending rigidity of the wide portion 312 is 0.4 or more and 0.85 or less.

"Bending rigidity" herein refers to the rigidity against bending on a straight line that is parallel to the longitudinal direction of the shoe 1. Specifically, the bending rigidity is measured by a three-point bending test. In this test, the distance between supports and the applied load during measurement of the bending rigidity of each portion are set constant. This is applied as well to measurement of the bending rigidity of a heel supporting region 330*c* and a heel supporting portion 332 which are described later herein.

In the present embodiment, the thickness of the midfoot supporting portion 320 is identical to the thickness of the curved portion 310. The curved portion 310 and the midfoot supporting portion 320 are shaped in such a manner that the dimension of the curved portion 310 and the dimension of the midfoot supporting portion 320 in the width direction are reduced gradually from the wide portion 312 toward the narrow portion 322. Specifically, an inner edge 301 of the plate 300 is shaped to extend gradually outward in the width direction, from the wide portion 312 toward the narrow portion 322. An outer edge 302 of the plate 300 is shaped to extend gradually inward in the width direction, from the wide portion 312 toward the narrow portion 322. The ratio of a dimension W2 of the narrow portion 322 in the width direction to a dimension W1 of the wide portion 312 in the width direction is 0.4 or more and 0.85 or less.

The ratio of the bending rigidity of the narrow region 320*b* to the bending rigidity of the wide region 310*a* may be adjusted by making the thickness of the midfoot supporting portion 320 different from the thickness of the curved portion 310, or adjusted by making a material forming the curved portion 310 different from a material forming the midfoot supporting portion 320, or adjusted by adding a reinforcement structure to the wide region 310*a* or the narrow region 320*b*.

As shown in FIG. 2, the plate 300 includes a middle portion 340 located midway between the wide portion 312 and the narrow portion 322 in the longitudinal direction. The ratio of a dimension WM, in the width direction, of the middle portion 340 to the dimension W2, in the width direction, of the narrow portion 322 is preferably less than 1.5. The ratio is more preferably closer to 1.0.

The plate 300 includes an inflected portion 342. The inflected portion 342 is a portion where the curvature of the inner edge 301 changes its orientation as seen in plan view of the plate 300. The inflected portion 342 is preferably formed between the wide portion 312 and the middle portion 340. Alternatively, the inflected portion 342 may be formed at a position overlapping the middle portion 340, or formed between the middle portion 340 and the narrow portion 322.

As seen in plan view of the plate 300, an angle formed between a line connecting the wide portion 312 on the inner edge 301 and the inflected portion 342 and a line connecting the narrow portion 322 on the inner edge 301 and the inflected portion 342 is preferably 160 degrees or more and 176 degrees or less. Accordingly, local flexure in the curved portion 310 can be suppressed. Moreover, as seen in plan view, the inner edge 301 has a portion between the inflected portion 342 and the narrow portion 322 and this portion therebetween is preferably made up of parts connected smoothly without a sudden shape change. For example, when this portion therebetween is made up of combined curves having a plurality of different curvatures, the difference between the maximum curvature and the minimum curvature is preferably 0.02 mm or less.

The outer edge 302 of the plate 300 may also include an inflected portion (not shown). In this case, preferably the inflected portion of the outer edge 302 also has features similar to those of the inflected portion 342 of the inner edge 301.

The rear-foot supporting portion 330 is located in the rear foot region 203. The rear-foot supporting portion 330 supports at least a part of the rear foot portion. The rear-foot supporting portion 330 is shaped to extend rearward from the rear end of the midfoot supporting portion 320. The rear-foot supporting portion 330 is shaped flat.

The rear-foot supporting portion 330 has a heel supporting region 330*c*. The heel supporting region 330*c* is a region that includes a heel supporting portion 332 supporting the center of the heel of the wearer, and extends in the width direction. As shown in FIG. 2, the heel supporting portion 332 is located on a heel center HC. The heel center HC refers to a line connecting the center of the heel bone of a standard wearer of the shoe 1, and a point between the third toe and the fourth toe. The ratio of the bending rigidity of the narrow region 320*b* to the bending rigidity of the heel supporting region 330*c* is preferably 0.8 or more. More specifically, the ratio of the bending rigidity of the narrow portion 322 to the bending rigidity of the heel supporting portion 332 is preferably 0.8 or more.

The midsole 200 includes a lower midsole 210 and an upper midsole 220.

The lower midsole 210 is placed under the plate 300. The outsole 100 is connected to the lower surface of the lower midsole 210. The lower midsole 210 is made for example of a foamed material of polyolefin resin, ethylene vinyl acetate (EVA), or polyamide-based thermoplastic elastomer (TPA, TPAE). The compressive elastic modulus of the lower midsole 210 is preferably set to 0.35 MPa or more and 2.5 MPa or less.

The lower midsole 210 supports the plate 300 in such a manner that a part of the plate 300 that extends rearward from the curved portion 310 has a posture separated gradually further away from the flat plane P, toward the rear in the longitudinal direction of the shoe 1. The lower midsole 210 preferably supports the plate 300 in such a manner that the part of the plate 300 that extends rearward from the curved portion 310 and the flat plane P form an angle of 5 degrees or more, for example. The lower midsole 210 also supports the plate 300 in such a manner that the curved portion 310 has a posture separated gradually further away from the flat plane P, toward the front in the longitudinal direction. The part of the plate 300 that extends rearward from the curved portion 310 may not be flat but may have a gentle curve or roughness in the thickness direction.

The lower midsole 210 includes a supporting portion 212. The supporting portion 212 supports the entire area of the curved portion 310. The thickness of a part of the supporting portion 212 that overlaps the plate 300 in the thickness direction and overlaps, in the thickness direction, at least a part extending frontward from the wide portion 312 is constant. The "thickness of a part of the supporting portion 212 that overlaps the plate 300 in the thickness direction and overlaps, in the thickness direction, at least a part extending frontward from the wide portion 312" herein refers to the substantial thickness of the part excluding a part having a locally-reduced thickness such as the so-called groove or the like. Moreover, "constant" thickness herein refers to the thickness of a portion having a difference of 25% or less between the minimum thickness and the maximum thickness. The supporting portion 212 is elastically deformable to allow the curved portion 310 to deform in such a manner that reduces the curvature of the wide region 310*a*.

The upper midsole 220 is placed over the plate 300. The upper 20 is placed over the upper midsole 220. The upper midsole 220 is made for example of a foamed material of polyolefin resin, EVA, or polyamide-based thermoplastic elastomer (TPA, TPAE). The upper midsole 220 may have a larger compressive elastic modulus than the compressive elastic modulus of the lower midsole 210. The compressive elastic modulus of the upper midsole 220 is preferably set to 0.35 MPa or more and 2.5 MPa or less, and more preferably set to 1 MPa or less. The upper midsole 220 may be identical in the compressive elastic modulus to the lower midsole 210, or may be smaller in the compressive elastic modulus than the lower midsole 210. While the upper midsole 220 and the lower midsole 210 are made of the same material, they may be made of different materials depending on the required properties.

Figure 4:
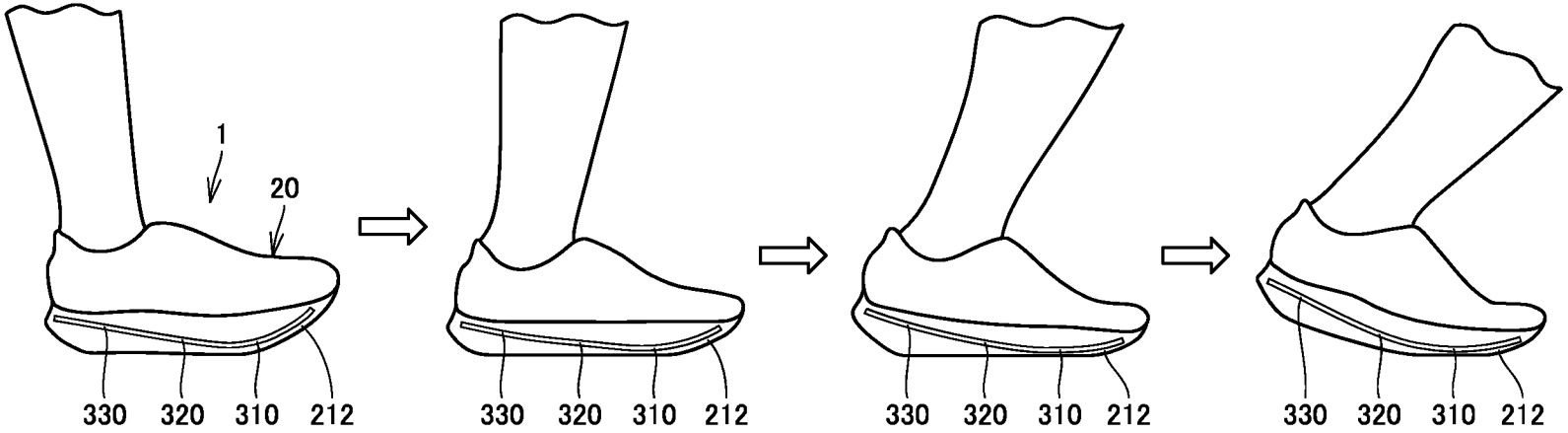
FIG. 4 schematically shows a phase from initial contact with the ground to take-off.

Next, with reference to FIG. 4, a change of the shape of the plate 300 and the lower midsole 210 during the phase from initial contact with the ground to take-off is described.

At the initial contact with the ground, a load is applied from around the heel to the shoe sole 10, and therefore, respective shapes of the curved portion 310 of the plate 300 and the supporting portion 212 of the lower midsole 210 remain substantially unchanged from those in the state where no load is applied to the curved portion 310 and the supporting portion 212.

In transition from the initial contact to the take-off, the load on the curved portion 310 and the supporting portion 212 increases gradually.

At the take-off, the maximum load acts on the curved portion 310 and the supporting portion 212. As the load acting on the curved portion 310 and the supporting portion 212 increases, the plate 300 is deformed in such a manner that the curved portion 310 is opened to reduce the curvature of the wide region 310*a* and the narrow region 320*b* is deformed in the direction away from the flat plane P (in the upward direction), and the supporting portion 212 is compressively deformed to allow the above-described deformation of the curved portion 310.

In this way, reduction of the angle of the ankle joint of the wearer at the take-off is suppressed, and therefore, the angular change of the ankle joint during the phase from the initial contact with the ground to the take-off is reduced. Accordingly, strain on the feet during running, for example, is reduced.

Specifically, the ratio of the bending rigidity of the narrow region 320*b* to the bending rigidity of the wide region 310*a* is 0.4 or more, and accordingly, deformation, at take-off, of the plate 300 in such a manner that only the narrow region 320*b* is deformed in the direction away from the flat plane P without allowing the curved portion 310 to open to reduce the curvature of the wide region 310*a* is suppressed. Accordingly, particularly reduction of the angle of the ankle joint at the take-off is suppressed.

Moreover, the ratio of the bending rigidity of the narrow region 320*b* to the bending rigidity of the wide region 310*a* is 0.85 or less, and accordingly, the curved portion 310 is opened effectively at the take-off to reduce the curvature of the wide region 310*a*, and therefore, reduction of the angle of the ankle joint of the wearer at the take-off is suppressed.

Figure 17:
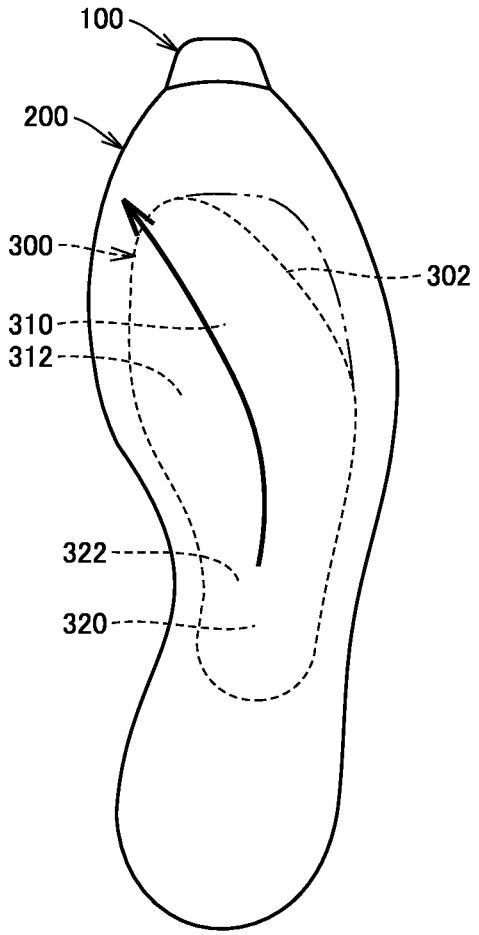
FIG. 17 is a plan view of a shoe sole showing a modification of the plate.
Figure 18:
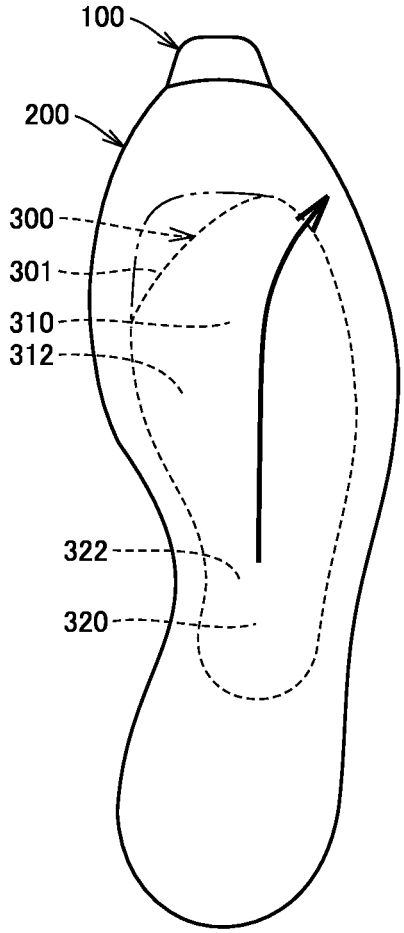
FIG. 18 is a plan view of a shoe sole showing a modification of the plate.

In the following, modifications of the above embodiment are described with reference to FIGS. 5 to 24. FIGS. 5 to 15 depict the outer contour of the plate 300 in the above embodiment by a dash-dot-dot line. FIGS. 17 and 18 depict the outer contour of the plate 300 shown in FIG. 16 by a dash-dot-dot line.

Figure 5:
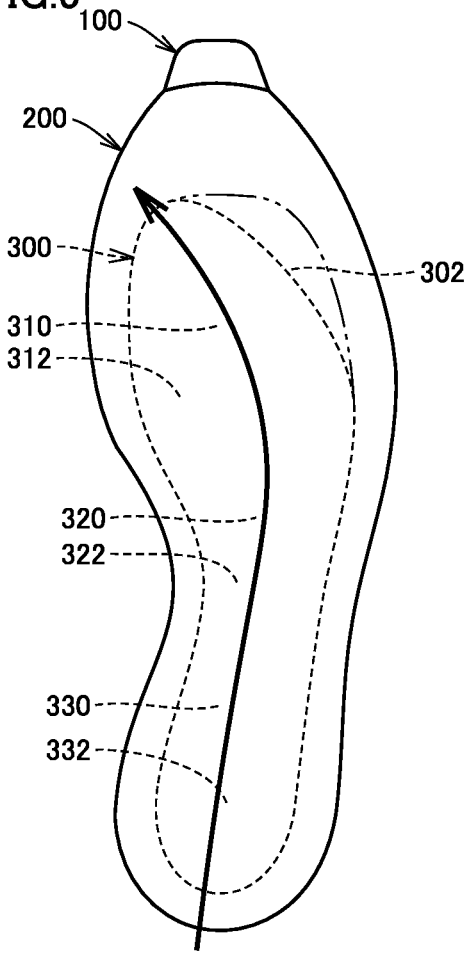
FIG. 5 is a plan view of a shoe sole showing a modification of the plate.

As shown in FIG. 5, the little-toe side of the curved portion 310 of the plate 300 may be recessed. As compared with the above embodiment, a part of the outer edge 302 that is located frontward from the wide portion 312 is recessed in such a shape that extends frontward to gradually approach the big toe. In this modification, a resilience force effective for take-off of the big-toe side is obtained.

Figure 6:
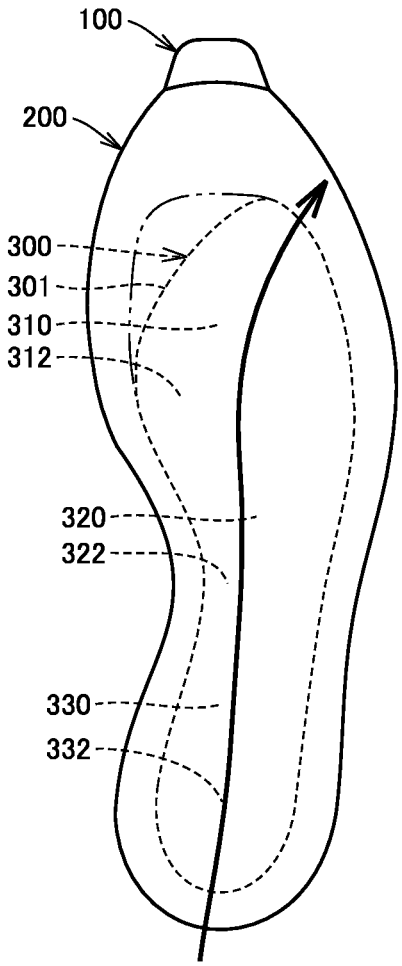
FIG. 6 is a plan view of a shoe sole showing a modification of the plate.

As shown in FIG. 6, the big-toe side of the curved portion 310 of the plate 300 may be recessed. As compared with the above embodiment, a part of the inner edge 301 that is located frontward from the wide portion 312 is recessed in such a shape that extends frontward to gradually approach the little toe. In this modification, a resilience force effective for take-off of the little-toe side is obtained.

Figure 7:
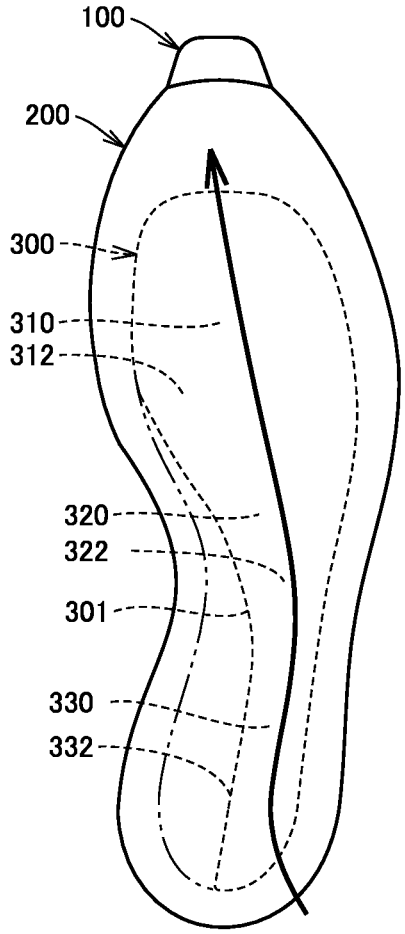
FIG. 7 is a plan view of a shoe sole showing a modification of the plate.

As shown in FIG. 7, the inner side of the midfoot supporting portion 320 and the rear-foot supporting portion 330 of the plate 300 may be recessed. As compared with the above embodiment, a part of the inner edge 301 that is located rearward from the wide portion 312 is recessed in such a manner that extends toward the outer edge 302 through the heel supporting portion 332. This modification is suitable for a wearer (runner or the like) who makes initial ground contact by the outer side of the heel.

Figure 8:
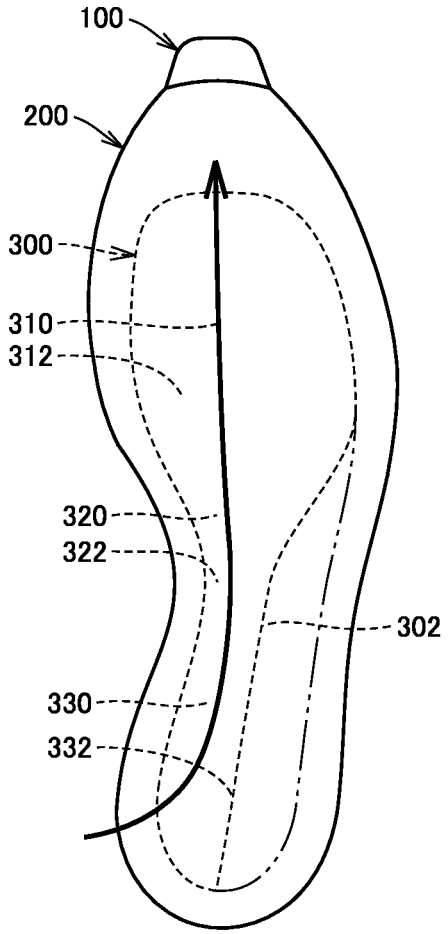
FIG. 8 is a plan view of a shoe sole showing a modification of the plate.

As shown FIG. 8, the outer side of the midfoot supporting portion 320 and the rear-foot supporting portion 330 of the plate 300 may be recessed. As compared with the above embodiment, a part of the outer edge 302 that is located rearward from the wide portion 312 is recessed in such a manner that extends toward the inner edge 301 through the heel supporting portion 332. This modification is suitable for a wearer who makes initial ground contact by the inner side of the heel.

Figure 9:
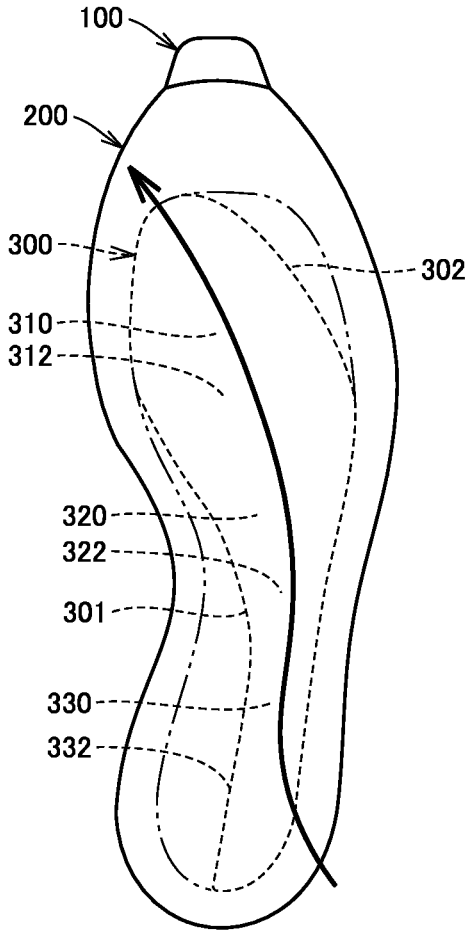
FIG. 9 is a plan view of a shoe sole showing a modification of the plate.

As shown in FIG. 9, the little-toe side of the curved portion 310 and the inner side of the midfoot supporting portion 320 and the rear-foot supporting portion 330 may be recessed. This modification has a shape of the combination of respective modifications shown in FIGS. 5 and 7. This modification is suitable for a wearer who makes initial ground contact by the outer side of the heel and makes take-off by the big-toe side.

Figure 10:
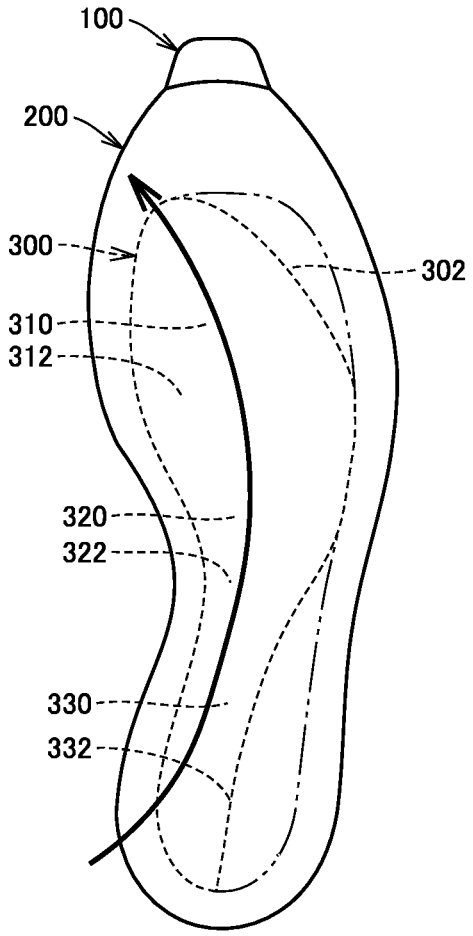
FIG. 10 is a plan view of a shoe sole showing a modification of the plate.

As shown in FIG. 10, the little-toe side of the curved portion 310 and the outer side of the midfoot supporting portion 320 and the rear-foot supporting portion 330 may be recessed. As compared with the above embodiment, a part of the outer edge 302 that is located frontward from the wide portion 312 is recessed in such a shape that extends frontward to gradually approach the big toe, similarly to the modification shown in FIG. 5, and a part of the outer edge 302 that is located rearward from the narrow portion 322 is recessed in such a manner that extends toward the inner edge 301 through the heel supporting portion 332. This modification is suitable for a wearer who makes initial ground contact by the inner side of the heel and makes take-off by the big-toe side.

Figure 11:
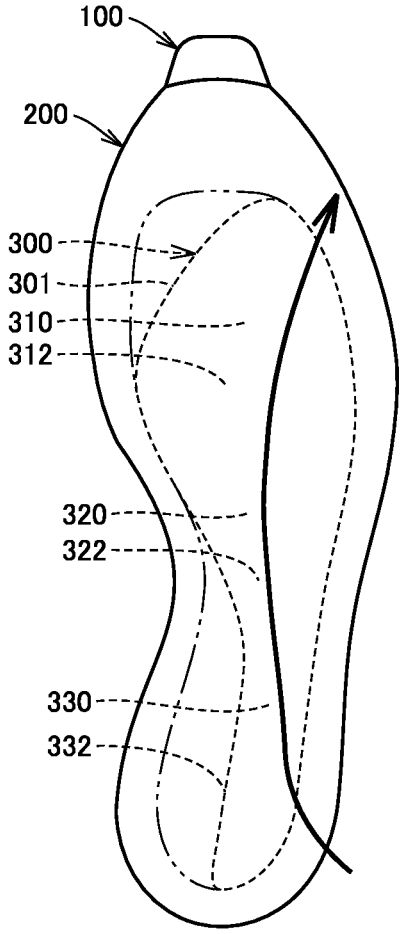
FIG. 11 is a plan view of a shoe sole showing a modification of the plate.

As shown in FIG. 11, the big-toe side of the curved portion 310 and the inner side of the midfoot supporting portion 320 and the rear-foot supporting portion 330 may be recessed. As compared with the above embodiment, a part of the inner edge 301 that is located frontward from the wide portion 312 is recessed in such a shape that extends frontward to gradually approach the little toe, similarly to the modification shown in FIG. 6, and a part of the inner edge 301 that is located rearward from the narrow portion 322 is recessed in such a manner that extends toward the outer edge 302 through the heel supporting portion 332. This modification is suitable for a wearer who makes initial ground contact by the outer side of the heel and makes take-off by the little-toe side.

Figure 12:
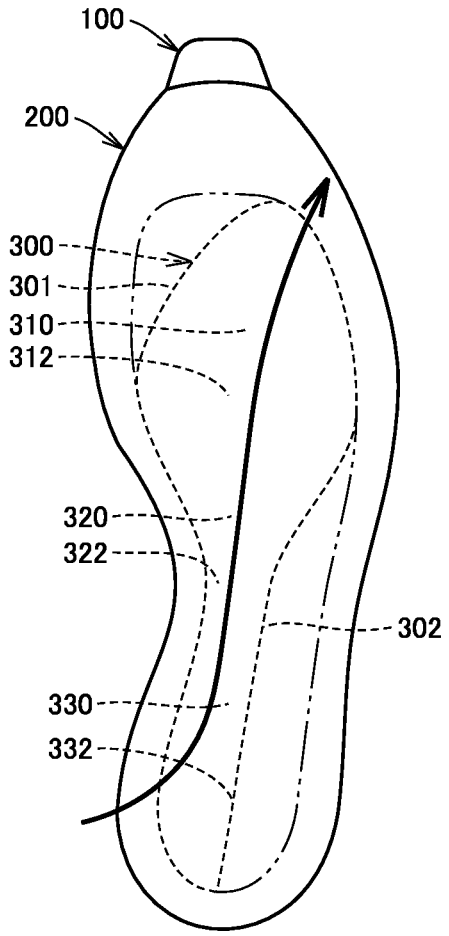
FIG. 12 is a plan view of a shoe sole showing a modification of the plate.

As shown in FIG. 12, the big-toe side of the curved portion 310 and the outer side of the midfoot supporting portion 320 and the rear-foot supporting portion 330 may be recessed. As compared with the above embodiment, a part of the inner edge 301 that is located frontward from the wide portion 312 is recessed in such a shape that extends frontward to gradually approach the little toe, similarly to the modification shown in FIG. 6, and a part of the outer edge 302 that is located rearward from the wide portion 312 is recessed in such a manner that extends toward the inner edge 301 through the heel supporting portion 332. This modification is suitable for a wearer who makes initial ground contact by the inner side of the heel and makes take-off by the little-toe side.

Figure 13:
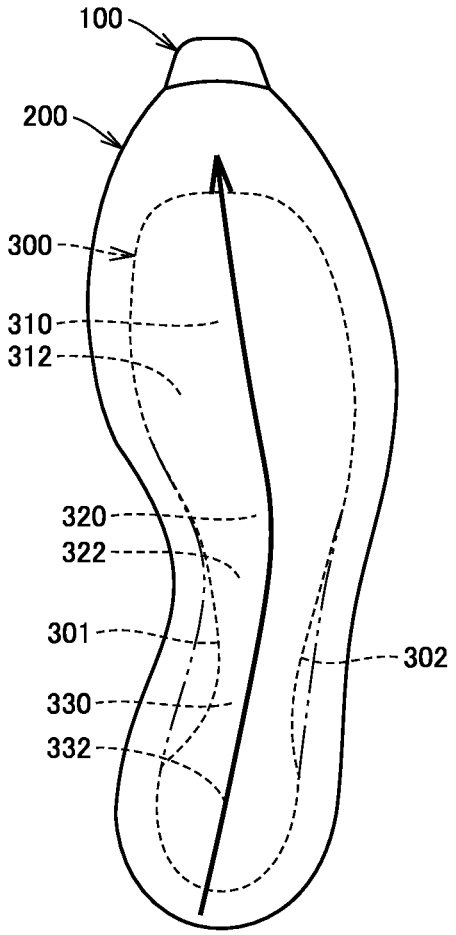
FIG. 13 is a plan view of a shoe sole showing a modification of the plate.

As shown in FIG. 13, the inner side and the outer side of the midfoot supporting portion 320 and the rear-foot supporting portion 330 may be recessed. As compared with the above embodiment, a part of the inner edge 301 that is located between the narrow portion 322 and the heel supporting portion 332 is recessed toward the outer edge 302 and a part of the outer edge 302 that is located between the narrow portion 322 and the heel supporting portion 332 is recessed toward the inner edge 301.

Figure 14:
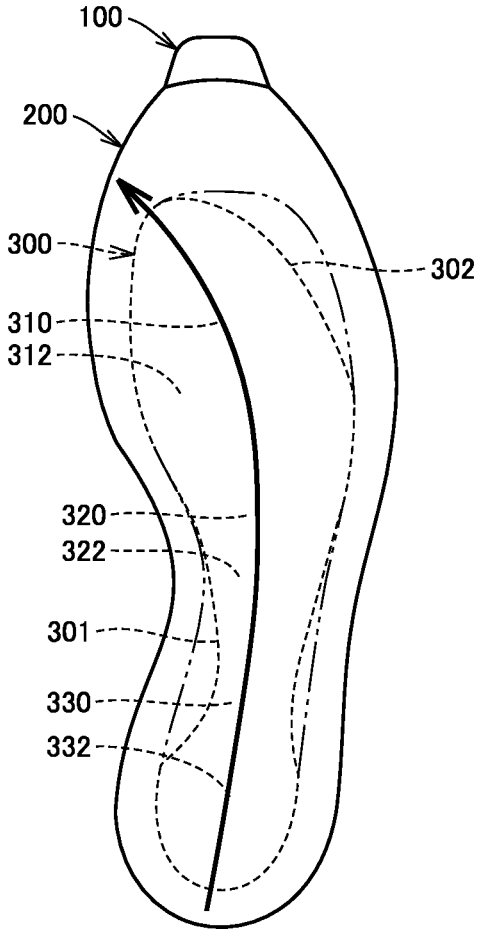
FIG. 14 is a plan view of a shoe sole showing a modification of the plate.

As shown in FIG. 14, the little-toe side of the curved portion 310 as well as the inner side and the outer side of the midfoot supporting portion 320 and the rear-foot supporting portion 330 may be recessed. This modification has a shape of the combination of respective modifications shown in FIGS. 5 and 13. In this modification, a resilience force effective for take-off of the big-toe side is obtained.

Figure 15:
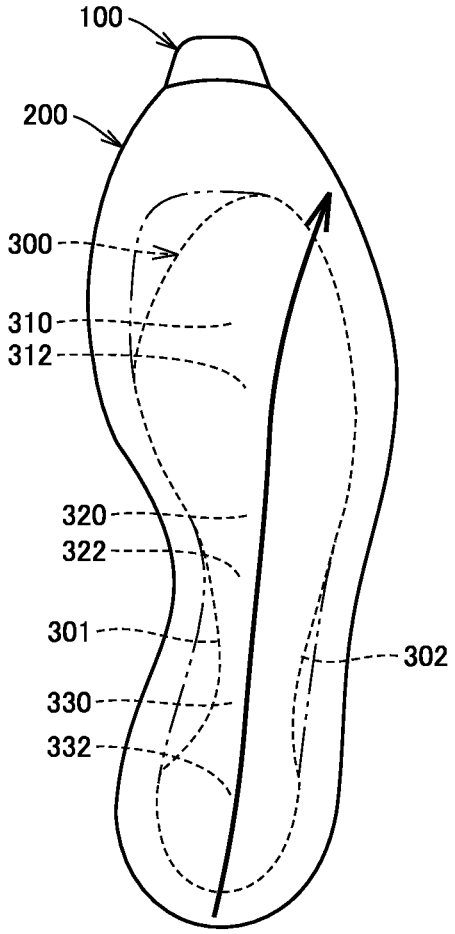
FIG. 15 is a plan view of a shoe sole showing a modification of the plate.

As shown in FIG. 15, the big-toe side of the curved portion 310 as well as the inner side and the outer side of the midfoot supporting portion 320 and the rear-foot supporting portion 330 may be recessed. This modification has a shape of the combination of respective modifications shown in FIGS. 6 and 13. In this modification, a resilience force effective for take-off of the little-toe side is obtained.

Figure 16:
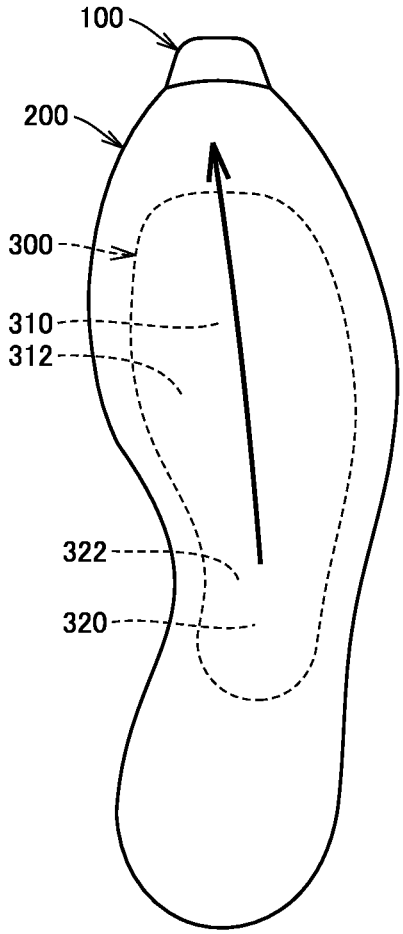
FIG. 16 is a plan view of a shoe sole showing a modification of the plate.

As shown in FIG. 16, the plate 300 may not have the rear-foot supporting portion 330. This modification is suitable for a wearer who makes initial ground contact by the forefoot portion. In this example, preferably the lower midsole 210 supports the plate 300 in such a manner that, as seen in a cross-sectional view of the shoe sole 10, the angle formed between the flat plane P and a line connecting the wide portion 312 and the narrow portion 322, or the angle formed between the flat plane P and a line connecting the narrow portion 322 and the rear end of the plate 300 is 5 degrees or more.

As shown in FIG. 17, the plate 300 may not have the rear-foot supporting portion 330 and the little-toe side of the curved portion 310 may be recessed. In this modification, in contrast to the modification shown in FIG. 16, a part of the outer edge 302 that is located frontward from the wide portion 312 is recessed in such a shape that extends frontward to gradually approach the big toe, similarly to the modification shown in FIG. 5. This modification is suitable for a wearer who makes initial ground contact by the forefoot portion and makes take-off by the big-toe side.

As shown in FIG. 18, the plate 300 may not have the rear-foot supporting portion 330 and the big-toe side of the curved portion 310 may be recessed. In this modification, in contrast to the modification shown in FIG. 16, a part of the inner edge 301 that is located frontward from the wide portion 312 is recessed in such a shape that extends frontward to gradually approach the little toe, similarly to the modification shown in FIG. 6. This modification is suitable for a wearer who makes initial ground contact by the forefoot portion and makes take-off by the little-toe side.

Figure 19:
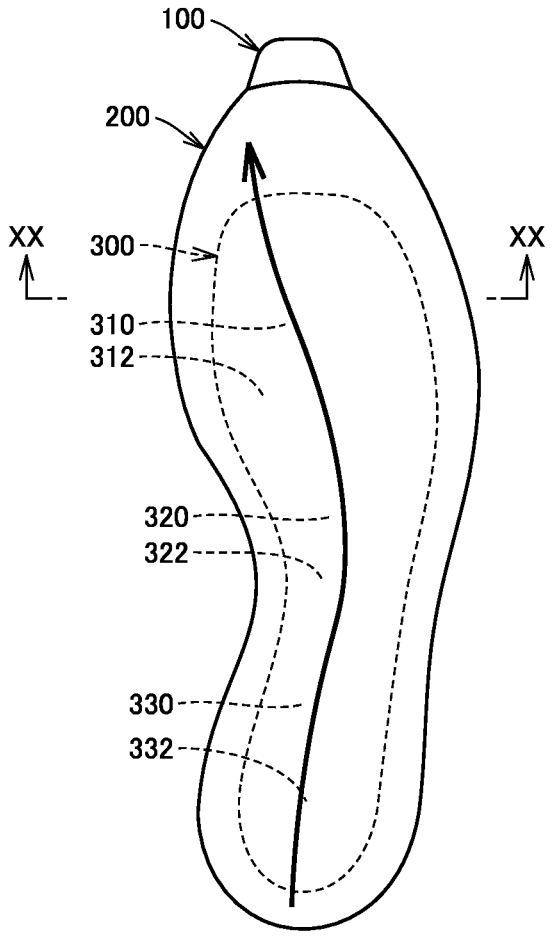
FIG. 19 is a plan view of a shoe sole showing a modification of the plate.
Figure 20:
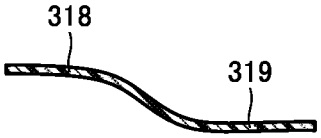
FIG. 20 is a cross-sectional view along a line XX-XX in FIG. 19.

As shown in FIGS. 19 and 20, a big-toe-side part 318 of the curved portion 310 may be formed higher than a little-toe-side part 319 of the curved portion 310. In this modification, a resilience force effective for take-off by the big-toe side is obtained.

Figure 21:
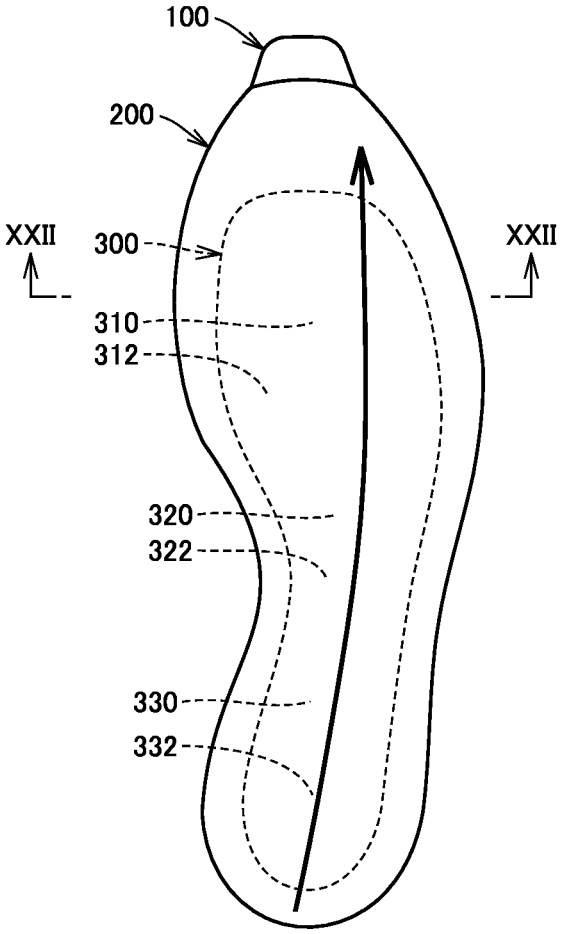
FIG. 21 is a plan view of a shoe sole showing a modification of the plate.
Figure 22:
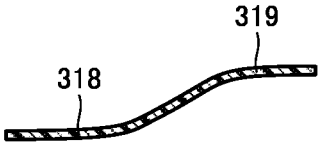
FIG. 22 is a cross-sectional view along a line XXII-XXII in FIG. 21.

As shown in FIGS. 21 and 22, the little-toe-side part 319 of the curved portion 310 may be formed higher than the big-toe-side part 318 of the curved portion 310. In this modification, a resilience force effective for take-off by the little-toe side is obtained.

Figure 23:
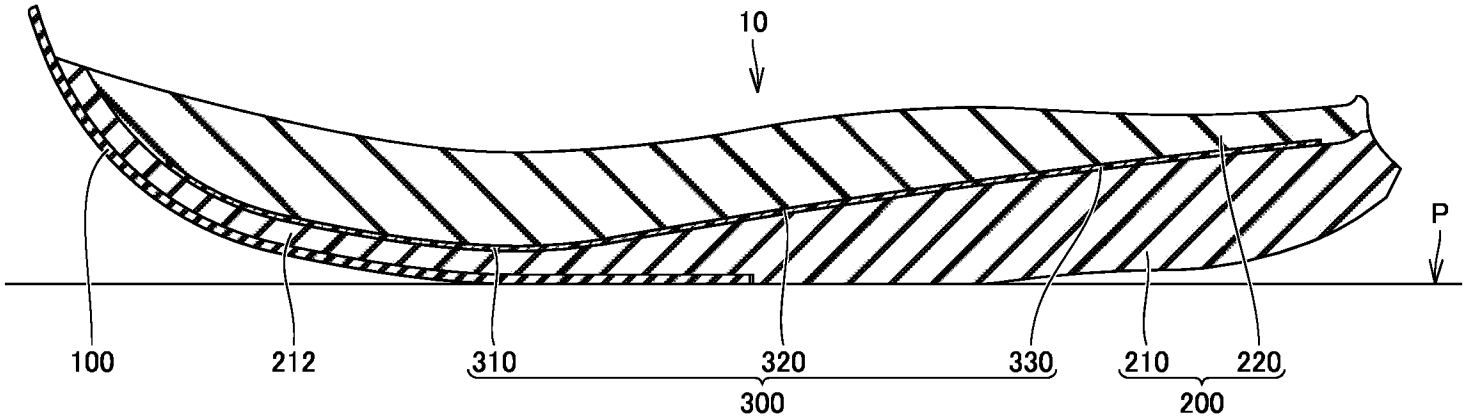
FIG. 23 is a cross-sectional view of a shoe sole showing a modification of the plate.
Figure 24:
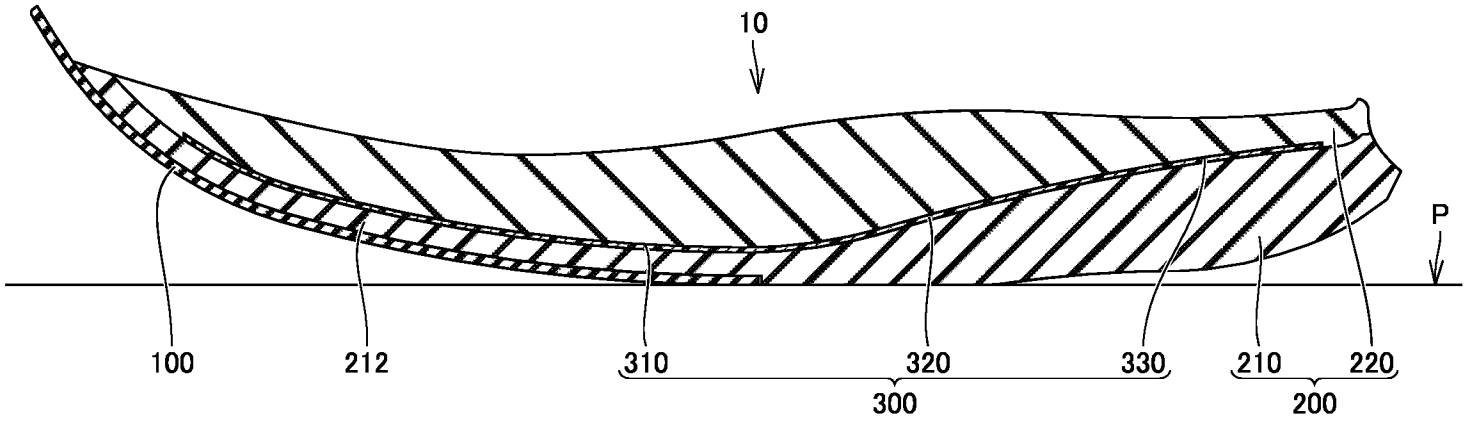
FIG. 24 is a cross-sectional view of a shoe sole showing a modification of the plate.

As shown in FIGS. 23 and 24, the curvature of the curved portion 310 may be set smaller. Further, as shown in FIG. 24, the rear end of the curved portion 310 may be located further rearward. In this example, the rear end of the curved portion 310 is preferably located within a range from the front end of the plate 300 to 65% of the total length of the plate 300.

It should be construed that the embodiments disclosed herein are given by way of illustration in all respects, not by way of limitation. It is intended that the scope of the present invention is defined by claims, not by the above description of the embodiments, and encompasses all modifications and variations equivalent in meaning and scope to the claims.

ASPECTS

It is appreciated by those skilled in the art that a plurality of exemplary embodiments described above are specific examples of the following aspects.

A plate according to an aspect of the present disclosure is a plate used for a shoe sole forming a part of a shoe, the plate includes: a curved portion located in a forefoot region of the shoe sole, the forefoot region overlapping, in a thickness direction of the shoe sole, a forefoot portion of a wearer of the shoe, the curved portion being shaped to curve toward a flat plane, in the shoe sole placed on the flat plane; a midfoot supporting portion located in a midfoot region of the shoe sole, the midfoot region overlapping, in the thickness direction, a midfoot portion of the wearer, the midfoot supporting portion supporting the midfoot portion; and a rear-foot supporting portion located in a rear foot region of the shoe sole, the rear foot region overlapping, in the thickness direction, a rear foot portion of the wearer, the rear-foot supporting portion supporting at least a part of the rear foot portion. The curved portion has a wide region including a wide portion of which dimension in a width direction is largest in the curved portion. The midfoot supporting portion has a narrow region including a narrow portion of which dimension in the width direction is smallest in the midfoot supporting portion. A ratio of a bending rigidity of the narrow region to a bending rigidity of the wide region is 0.4 or more and 0.85 or less.

At take-off, the plate is deformed in such a manner that the curved portion is opened to reduce the curvature of the wide region and the narrow region is deformed in the direction away from the flat plane (in the upward direction). Accordingly, reduction of the dorsiflexion angle of the ankle joint of the wearer at the take-off is suppressed, and therefore, the angular change of the ankle joint during the phase from the initial contact with the ground to the take-off is reduced. Accordingly, energy generated by the ankle joint during the stance phase of running, for example, is reduced effectively.

Preferably, the plate includes a middle portion located midway between the wide portion and the narrow portion in a longitudinal direction of the shoe, and a ratio of a dimension, in the width direction, of the middle portion to the dimension, in the width direction, of the narrow portion is less than 1.5.

Preferably, the plate includes an inner edge formed by an inner side of the plate, and the inner edge includes an inflected portion formed between the wide portion and the middle portion and having a curvature that changes its orientation as seen in plan view of the plate.

In this case, preferably an angle formed between a line connecting the wide portion on the inner edge and the inflected portion and a line connecting the narrow portion on the inner edge and the inflected portion is 160 degrees or more and 176 degrees or less.

Preferably, the curved portion is identical in thickness to the midfoot supporting portion, the curved portion and the midfoot supporting portion are shaped in such a manner that a dimension of the curved portion and a dimension of the midfoot supporting portion in the width direction are reduced gradually from the wide portion toward the narrow portion, and a ratio of a dimension, in the width direction, of the narrow portion to a dimension, in the width direction, of the wide portion is 0.4 or more and 0.85 or less.

Preferably, the rear-foot supporting portion has a heel supporting region that includes a heel supporting portion supporting a center of a heel of the wearer, and extends in the width direction, and a ratio of the bending rigidity of the narrow region to a bending rigidity of the heel supporting region is 0.8 or more.

Preferably, the narrow region is formed flat.

A shoe sole according to an aspect of the present disclosure includes: the plate as described above; a midsole including the forefoot region, the midfoot region, and the rear foot region. The plate is placed within the midsole in such a manner that the curved portion is located in the forefoot region and the midfoot supporting portion is located in the midfoot region. The midsole includes: a lower midsole placed under the plate; and an upper midsole placed over the plate. The lower midsole includes a supporting portion that supports an entire area of the curved portion. The supporting portion is elastically deformable to allow the curved portion to deform in such a manner that reduces a curvature of the wide region. A thickness of a part of the supporting portion that overlaps the plate in the thickness direction and overlaps, in the thickness direction, at least a part extending frontward from the wide portion is constant.

Preferably, the lower midsole supports the plate in such a manner that a part of the plate that extends rearward from the curved portion has a posture separated gradually further away from the flat plane, toward a rear in the longitudinal direction of the shoe.

A shoe according to an aspect of the present disclosure includes: a shoe sole as described above; and an upper connected to the shoe sole and located over the shoe sole.

While embodiments of the present invention have been described, it should be construed that the embodiments disclosed herein are given by way of illustration in all respects, not by way of limitation. It is intended that the scope of the present invention is defined by claims, and encompasses all modifications and variations equivalent in meaning and scope to the claims.

What is claimed is:

1. A plate used for a shoe sole forming a part of a shoe, the plate comprising:

a curved portion located in a forefoot region of the shoe sole, the forefoot region overlapping, in a thickness direction of the shoe sole, a forefoot portion of a wearer when wearing the shoe, the curved portion being shaped to curve toward a flat plane, in the shoe sole placed on the flat plane;

a midfoot supporting portion located in a midfoot region of the shoe sole, the midfoot region overlapping, in the thickness direction, a midfoot portion of the wearer when wearing the shoe, the midfoot supporting portion supporting the midfoot portion; and a rear-foot supporting portion located in a rear foot region of the shoe sole, the rear foot region overlapping, in the thickness direction, a rear foot portion of the wearer when wearing the shoe, the rear-foot supporting portion supporting at least a part of the rear foot portion, wherein:

the curved portion includes a wide region including a wide portion of which dimension in a width direction is largest in the curved portion, the midfoot supporting portion includes a narrow region including a narrow portion of which dimension in the width direction is smallest in the midfoot supporting portion, and a ratio of a bending rigidity of the narrow region to a bending rigidity of the wide region is in a range of 0.4 to 0.85.

2. The plate according to claim 1, wherein:

the plate includes a middle portion located midway between the wide portion and the narrow portion in a longitudinal direction of the shoe, and a ratio of a dimension, in the width direction, of the middle portion to the dimension, in the width direction, of the narrow portion is less than 1.5.

3. The plate according to claim 2, wherein:

the plate includes an inner edge formed by an inner side of the plate, and the inner edge includes an inflected portion formed between the wide portion and the middle portion and having a curvature that changes its orientation.

4. The plate according to claim 3, wherein an angle formed between a line connecting the wide portion on the inner edge and the inflected portion and a line connecting the narrow portion on the inner edge and the inflected portion is in a range of 160 degrees to 176 degrees.

5. A shoe sole comprising:
the plate according to claim 4; and
a midsole including the forefoot region, the midfoot region, and the rear foot region, wherein
the plate is placed within the midsole in such a manner that the curved portion is located in the forefoot region and the midfoot supporting portion is located in the midfoot region,
the midsole includes:
a lower midsole placed under the plate; and
an upper midsole placed over the plate,
the lower midsole includes a supporting portion that supports an entire area of the curved portion,
the supporting portion is elastically deformable to allow the curved portion to deform in such a manner that reduces a curvature of the wide region, and
wherein at least a part of the supporting portion extending frontward from the wide portion includes a constant thickness.

6. The plate according to claim 4, wherein:
the curved portion is identical in thickness to the midfoot supporting portion,
the curved portion and the midfoot supporting portion are shaped in such a manner that a dimension of the curved portion and a dimension of the midfoot supporting portion in the width direction are reduced gradually from the wide portion toward the narrow portion, and
a ratio of a dimension, in the width direction, of the narrow portion to a dimension, in the width direction, of the wide portion is in a range of 0.4 to 0.85.

7. A shoe sole comprising:
the plate according to claim 3; and
a midsole including the forefoot region, the midfoot region, and the rear foot region, wherein
the plate is placed within the midsole in such a manner that the curved portion is located in the forefoot region and the midfoot supporting portion is located in the midfoot region,
the midsole includes:
a lower midsole placed under the plate; and
an upper midsole placed over the plate,
the lower midsole includes a supporting portion that supports an entire area of the curved portion,
the supporting portion is elastically deformable to allow the curved portion to deform in such a manner that reduces a curvature of the wide region, and
wherein at least a part of the supporting portion extending frontward from the wide portion includes a constant thickness.

8. The plate according to claim 3, wherein:
the curved portion is identical in thickness to the midfoot supporting portion,
the curved portion and the midfoot supporting portion are shaped in such a manner that a dimension of the curved portion and a dimension of the midfoot supporting portion in the width direction are reduced gradually from the wide portion toward the narrow portion, and
a ratio of a dimension, in the width direction, of the narrow portion to a dimension, in the width direction, of the wide portion is in a range of 0.4 to 0.85.

9. A shoe sole comprising:
the plate according to claim 2; and
a midsole including the forefoot region, the midfoot region, and the rear foot region, wherein
the plate is placed within the midsole in such a manner that the curved portion is located in the forefoot region and the midfoot supporting portion is located in the midfoot region,
the midsole includes:
a lower midsole placed under the plate; and
an upper midsole placed over the plate,
the lower midsole includes a supporting portion that supports an entire area of the curved portion,
the supporting portion is elastically deformable to allow the curved portion to deform in such a manner that reduces a curvature of the wide region, and
wherein at least a part of the supporting portion extending frontward from the wide portion includes a constant thickness.

10. The plate according to claim 2, wherein:
the curved portion is identical in thickness to the midfoot supporting portion,
the curved portion and the midfoot supporting portion are shaped in such a manner that a dimension of the curved portion and a dimension of the midfoot supporting portion in the width direction are reduced gradually from the wide portion toward the narrow portion, and
a ratio of a dimension, in the width direction, of the narrow portion to a dimension, in the width direction, of the wide portion is in a range of 0.4 to 0.85.

11. The plate according to claim 2, wherein:
the rear-foot supporting portion includes a heel supporting region that includes a heel supporting portion supporting a center of a heel of the wearer when worn, and extends in the width direction, and
a ratio of the bending rigidity of the narrow region to a bending rigidity of the heel supporting region is 0.8 or more.

12. The plate according to claim 1, wherein:
the curved portion is identical in thickness to the midfoot supporting portion,
the curved portion and the midfoot supporting portion are shaped in such a manner that a dimension of the curved portion and a dimension of the midfoot supporting portion in the width direction are reduced gradually from the wide portion toward the narrow portion, and
a ratio of a dimension, in the width direction, of the narrow portion to a dimension, in the width direction, of the wide portion is in a range of 0.4 to 0.85.

13. A shoe sole comprising:
the plate according to claim 12; and
a midsole including the forefoot region, the midfoot region, and the rear foot region, wherein
the plate is placed within the midsole in such a manner that the curved portion is located in the forefoot region and the midfoot supporting portion is located in the midfoot region,
the midsole includes:
a lower midsole placed under the plate; and
an upper midsole placed over the plate,
the lower midsole includes a supporting portion that supports an entire area of the curved portion,
the supporting portion is elastically deformable to allow the curved portion to deform in such a manner that reduces a curvature of the wide region, and
wherein at least a part of the supporting portion extending frontward from the wide portion includes a constant thickness.

14. The plate according to claim 1, wherein:
the rear-foot supporting portion includes a heel supporting region that includes a heel supporting portion supporting a center of a heel of the wearer when worn, and extends in the width direction, and a ratio of the bending rigidity of the narrow region to a bending rigidity of the heel supporting region is 0.8 or more.

15. A shoe sole comprising:

the plate according to claim 14; and a midsole including the forefoot region, the midfoot region, and the rear foot region, wherein the plate is placed within the midsole in such a manner that the curved portion is located in the forefoot region and the midfoot supporting portion is located in the midfoot region, the midsole includes:

a lower midsole placed under the plate; and an upper midsole placed over the plate, the lower midsole includes a supporting portion that supports an entire area of the curved portion, the supporting portion is elastically deformable to allow the curved portion to deform in such a manner that reduces a curvature of the wide region, and wherein at least a part of the supporting portion extending frontward from the wide portion includes a constant thickness.

16. The plate according to claim 1, wherein the narrow region is formed flat.

17. A shoe sole comprising:

the plate according to claim 16; and a midsole including the forefoot region, the midfoot region, and the rear foot region, wherein the plate is placed within the midsole in such a manner that the curved portion is located in the forefoot region and the midfoot supporting portion is located in the midfoot region, the midsole includes:

a lower midsole placed under the plate; and an upper midsole placed over the plate, the lower midsole includes a supporting portion that supports an entire area of the curved portion, the supporting portion is elastically deformable to allow the curved portion to deform in such a manner that reduces a curvature of the wide region, and wherein at least a part of the supporting portion extending frontward from the wide portion includes a constant thickness.

18. A shoe sole comprising:

the plate according to claim 1; and a midsole including the forefoot region, the midfoot region, and the rear foot region, wherein the plate is placed within the midsole in such a manner that the curved portion is located in the forefoot region and the midfoot supporting portion is located in the midfoot region, the midsole includes:

a lower midsole placed under the plate; and an upper midsole placed over the plate, the lower midsole includes a supporting portion that supports an entire area of the curved portion, the supporting portion is elastically deformable to allow the curved portion to deform in such a manner that reduces a curvature of the wide region, and wherein at least a part of the supporting portion extending frontward from the wide portion includes a constant thickness.

19. The shoe sole according to claim 18, wherein the lower midsole supports the plate in such a manner that a part of the plate that extends rearward from the curved portion and extends to a rearmost portion of the plate includes a posture separated gradually further away from the flat plane, in a longitudinal direction of the shoe.

20. A shoe comprising:

the shoe sole according to claim 18; and an upper connected to the shoe sole and located over the shoe sole.

* * * * *